US011885027B2

(12) United States Patent
Semkow et al.

(10) Patent No.: US 11,885,027 B2
(45) Date of Patent: Jan. 30, 2024

(54) ACTIVATION OF SELF-PASSIVATING METALS USING REAGENT COATINGS FOR LOW TEMPERATURE NITROCARBURIZATION

(71) Applicant: Swagelok Company, Solon, OH (US)

(72) Inventors: Christina Semkow, University Heights, OH (US); Cyprian Adair William Illing, Cleveland Heights, OH (US); Peter C. Williams, Cleveland Heights, OH (US); Wayne Ostrosky, Novelty, OH (US)

(73) Assignee: SWAGELOK COMPANY, Solon, OH (US)

( * ) Notice: Subject to any disclaimer, the term of this patent is extended or adjusted under 35 U.S.C. 154(b) by 87 days.

(21) Appl. No.: 17/242,555

(22) Filed: Apr. 28, 2021

(65) Prior Publication Data

US 2021/0340659 A1 Nov. 4, 2021

Related U.S. Application Data

(60) Provisional application No. 63/076,425, filed on Sep. 10, 2020, provisional application No. 63/076,419, filed on Sep. 10, 2020, provisional application No. 63/017,259, filed on Apr. 29, 2020, provisional application No. 63/017,265, filed on Apr. 29, 2020, provisional application No. 63/017,262, filed on Apr. 29, 2020, provisional application No. 63/017,277, filed on Apr. 29, 2020, provisional application No. 63/017,271, filed on Apr. 29, 2020.

(51) Int. Cl.

| | |
|---|---|
| ***C23C 8/02*** | (2006.01) |
| ***C23C 8/32*** | (2006.01) |
| ***C23C 8/80*** | (2006.01) |

(52) U.S. Cl.

CPC ..... *C23C 8/02* (2013.01); *C23C 8/32* (2013.01); *C23C 8/80* (2013.01)

(58) Field of Classification Search

CPC ..... C23C 8/02; C23C 8/04; C23C 8/32
See application file for complete search history.

(56) References Cited

U.S. PATENT DOCUMENTS

| | | | |
|---|---|---|---|
| 2,789,930 | A | 4/1957 | Englehard |
| 3,232,797 | A | 2/1966 | Besson |
| 4,036,482 | A | 7/1977 | Kieferle |
| 4,844,949 | A | 7/1989 | Arai |
| 5,014,646 | A | 5/1991 | Ito et al. |
| 5,443,662 | A | 8/1995 | Arai et al. |
| 5,556,483 | A | 9/1996 | Masaaki |
| 5,593,510 | A | 1/1997 | Masaaki |
| 5,792,282 | A | 8/1998 | Masaaki |
| 6,093,303 | A | 7/2000 | Williams |
| 6,165,597 | A | 12/2000 | Williams |
| 6,547,888 | B1 | 4/2003 | Williams |
| 8,414,710 | B2 | 4/2013 | Minemura et al. |
| 8,784,576 | B2 | 7/2014 | Somers |
| 8,845,823 | B2 | 9/2014 | Christiansen et al. |
| 9,738,962 | B2 | 8/2017 | Bremer et al. |
| 10,214,805 | B2 | 2/2019 | Williams et al. |
| 10,604,832 | B2 | 3/2020 | Williams |
| 11,193,197 | B2 | 12/2021 | Illing |
| 11,473,183 | B2 | 10/2022 | Williams |
| 11,649,538 | B2 | 5/2023 | Illing |
| 2002/0014281 | A1 | 2/2002 | Heishi |
| 2004/0175407 | A1 | 9/2004 | McDaniel |
| 2006/0090817 | A1 | 5/2006 | Somers et al. |
| 2011/0123907 | A1 | 5/2011 | Yau |
| 2012/0111456 | A1 | 5/2012 | Christianson et al. |
| 2013/0136868 | A1 | 5/2013 | Bruck et al. |
| 2013/0240090 | A1 | 9/2013 | Watanabe |
| 2016/0032442 | A1 | 2/2016 | Williams et al. |
| 2016/0298203 | A1 | 10/2016 | Hackel |
| 2017/0165791 | A1 | 6/2017 | Kamachi |
| 2017/0166986 | A1 | 6/2017 | Schiroky |
| 2018/0119239 | A1 | 5/2018 | Tuffile |
| 2019/0376173 | A1 | 12/2019 | Illing |
| 2020/0283882 | A1 | 9/2020 | Williams |
| 2021/0172046 | A1 | 6/2021 | Illing et al. |
| 2021/0134065 | A1 | 11/2021 | Semkow |
| 2022/0064778 | A1 | 3/2022 | Illing |
| 2022/0072618 | A1 | 3/2022 | Illing |

(Continued)

FOREIGN PATENT DOCUMENTS

| | | |
|---|---|---|
| CN | 1067929 | 1/1993 |
| CN | 102828145 | 12/2012 |

(Continued)

OTHER PUBLICATIONS

Agaponova, "Encapsulation Method for Surface Engineering of Corrosion-Resistant Alloys by Low Temperature Nitro-Carburization" , Thesis, Case Western Reserve University, Jan. 2015 (year 2016).*

Stickles "Gas Carburizing" pp. 312-324, vol. 4, ASM Handbook, 1991, ASM International.

Ge et al. "The Effect of Surface Finish on Low-Temperature Acetylene-Based Carburization of 316L Austenitic Stainless Steel", Metallurgical and Materials Transactions B, vol. 458, Dec. 2014, pp. 2338-2345, copyright 2014 The Minerals, Metal and Materials Society and ASM International.

Netzsch brochure, Fourier Transform Infrared (FT-IR) Spectrometers Coupled to Thermal Analysis, 24, pgs, date unknown but at least as early as the filing date of this subject application.

International Search Report and Written Opinion from PCT/US2021/029541 dated Aug. 5, 2021.

Anh et al. "First-principles study of hydrogen-enhanced phosphorus diffusion in silicon", Journal of Applied Physics, 119, 8 pgs., (2016).

(Continued)

*Primary Examiner* — Jessee R Roe
(74) *Attorney, Agent, or Firm* — Calfee, Halter & Griswold LLP

(57) ABSTRACT

A method for treating a workpiece made of self-passivating metal and having a Beilby layer including applying a coating to a surface of the workpiece, the coating including a reagent, treating the coating to thermally alter the reagent, wherein the thermal altering of the reagent activates and/or hardens the surface.

33 Claims, No Drawings

(56) References Cited

U.S. PATENT DOCUMENTS

| | | | |
|---|---|---|---|
| 2022/0364216 | A1 | 11/2022 | Ernst |
| 2023/0015135 | A1 | 1/2023 | Williams |

FOREIGN PATENT DOCUMENTS

| | | |
|---|---|---|
| CN | 103215536 | 7/2013 |
| CN | 103314132 | 9/2013 |
| DE | 4342730 | 6/1995 |
| EP | 516899 | 12/1991 |
| EP | 787817 | 8/1997 |
| EP | 2278038 | 1/2011 |
| GB | 1023337 | 3/1966 |
| JP | S50-109827 | 8/1975 |
| JP | S52128847 | 10/1977 |
| JP | 9-071853 | 3/1997 |
| JP | 9-268364 | 10/1997 |
| JP | 2005-232518 | 9/2005 |
| JP | 2005-532471 | 10/2005 |
| JP | 2009-517542 | 4/2009 |
| SU | 1687645 | 10/1991 |
| WO | 2006/136166 | 12/2006 |
| WO | 2011/009463 | 1/2011 |
| WO | 2015/066320 | 5/2015 |
| WO | 2016/027042 | 5/2016 |
| WO | 2019/241011 | 12/2019 |

OTHER PUBLICATIONS

Bond, "The role of carbon deposits in metal-catalysed reactions of hydrocarbons", Applied Catalysis A: General., vol. 149, No. 1, pp. 3-25, Jan. 1997.
Edelmann, Chapter Two, "Recent Progress in the Chemistry of Metal Amidinates and Guanidinates: Syntheses, Catalysis and Materials", Advances in Organometallic Chemistry, vol. 61, p. 2 (Scheme 2.1) and p. 4 (Scheme 2.2), (2013). (submitted in two separate PDF's due to size limitation).
Gu et al. "Numerical Simulations of Carbon and Nitrogen Composition Depth Profiles in Nitrocarburized Austenitic Stainless Steels", Metal. and Mater. Transactions A, 45A, pp. 4268-4279 (2014).
Guanidine Hci 6M—GMP Denaturant, Bio Pharma Grade, GH4120, CAS#50-01-1, 2 pgs., Apr. 25, 2021.
Johnson et al., "Chemisorption and thermal decomposition of methylamine on the ruthenium (001) surface", J. Am. Chem. Soc. vol. 114, No. 11, pp. 4279-0490, May 1992.
Kuncicka et al. "Advances in metals and alloys for joint replacement", Progress in Materials Science, 88, pp. 232-280, 2017.
Palmer et al. "Preparation and Extraction of INsuluble (Inclusion-Body) Proteins from *Escherichia coli* ", 1 pg., copyright 2000.
Ren et al. "Electronic impact of concentrated interstitial carbon on physical properties of AISI-316 austenitic stainless steel", Acta Materialia, 173, pp. 96-105 (2019).
Ren et al. "Ultrahigh-strength AISI-316 austenitic stainless steel foils through concentrated interstitial carbon", Acta Materialia, 167, pp. 231-240 (2019).
Schaber et al. "Thermal decomposition (pyrolysis) of urea in an open reaction vessel", Thermochimica Acta. 424, pp. 131-142 (2004).
Schneider, et al. Introduction to Surface Hardening of Steels, ASM Handbook, vol. 4A, Steel Heat Treating Fundamentals and Processes, copyright 2013, pp. 389-398.
Shen Chengjin et al., "Heat Treatment of Materials and Surface Engineering", China Mining University Press, p. 218.
Silcotek, "Impoving Corrosion Resistance in Biopharmaceuticals", one p. Apr. 25, 2021.
STAG Melissen et al., "DFT Perspective on the Thermochemistry of Carbon Nitride Synthesis", J. of Physical Chemistry C. vol. 120, No. 43, p. 24542-24550, Nov. 2016.
Zhu et al., "Graphitic Carbon Nitride: Synthesis, Properties, and Applications in Catalysis", ASC Applied Materials & Interfaces, vol. 6, No. 19, p. 16449-16465, Oct. 2014.
International Search Report and Written Opinion from PCT/US2015/042785 dated Oct. 28, 2015.
International Search Report and Written Opinion from PCT/US19/035694 dated Aug. 2, 2019.
International Search Report from PCT/US2020/063284 dated Apr. 13, 2021.
International Search Report and Written Opinion from PCT/US2021/049600 dated May 19, 2022.
International Search Report and Written Opinion from PCT/US2022/026640 dated Jun. 24, 2022.
Notice of Allowance from U.S. Appl. No. 14/813,290 dated Oct. 17, 2018.
Office action from U.S. Appl. No. 17/112,076 dated Nov. 30, 2022.
Office action from U.S. Appl. No. 17/112,076 dated May 5, 2023.
Office action from U.S. Appl. No. 17/470,287 dated Mar. 3, 2023.
Office action from Chinese Application No. 201580040222.9 dated Aug. 14, 2018.
Office action from Chinese Application No. 202011268560.7 dated Aug. 10, 2022.
Search Report from European Application No. 15828180.8 dated Feb. 20, 2018.
Communication from European Application No. 22177892.1 dated Oct. 11, 2022.
Office action from Japanese Application No. 2020-567961 dated May 23, 2023.
Office action from U.S. Appl. No. 16/433,083 dated Apr. 21, 2021.
Notice of Allowance from U.S. Appl. No. 16/433,083 dated Aug. 4, 2021.
Office action from U.S. Appl. No. 16/832,253 dated Mar. 9, 2022.
Notice of Allowance from U.S. Appl. No. 16/832,253 dated Jun. 20, 2022.
Office action from U.S. Appl. No. 17/524,031 dated Aug. 6, 2022.
Notice of Allowance from U.S. Appl. No. 17/524,031 dated Dec. 12, 2022.
International Search Report from PCT/US2023/067444 dated Aug. 21, 2023.
Office action from Japanese Application No. 2020-567961 dated Oct. 31, 2023.

* cited by examiner

ACTIVATION OF SELF-PASSIVATING METALS USING REAGENT COATINGS FOR LOW TEMPERATURE NITROCARBURIZATION

Many of the features described in the present disclosure relate to U.S. Pat. No. 10,214,805, entitled Enhanced Activation of Self-Passivating Metals, the entire disclosure of which is incorporated herein by reference. Many of the features also relate to U.S. patent application Ser. No. 16/433,083, now U.S. Pat. No. 11,649,538, filed Jun. 6, 2019, the entire disclosure of which is incorporated herein by reference.

This application claims priority to, and any benefit of, U.S. Provisional Patent Application No. 63/017,277, "ACTIVATION OF SELF-PASSIVATING METALS USING REAGENT COATINGS FOR LOW TEMPERATURE NITROCARBURIZATION," filed on Apr. 29, 2020, U.S. Provisional Patent Application No. 63/076,419, "ACTIVATION OF SELF-PASSIVATING METALS USING REAGENT COATINGS FOR LOW TEMPERATURE NITROCARBURIZATION WITH MACHINING OIL," filed on Sep. 10, 2020, U.S. Provisional Patent Application No. 63/017,262, "FAST HARDENING OF SELF-PASSIVATING METALS VIA CARBON-ENHANCED LAYER EXCLUDING COARSE PRECIPITATE", filed on Apr. 29, 2020; U.S. Provisional Application No. 63/017,259, "FAST HARDENING OF SELF-PASSIVATING METALS USING LOW TEMPERATURE NITROCARBURIZATION," filed on Apr. 29, 2020, U.S. Provisional Patent Application No. 63/076,425, "FAST HARDENING OF SELF-PASSIVATING METALS USING LOW TEMPERATURE NITROCARBURIZATION," filed on Sep. 10, 2020; U.S. Provisional Patent Application No. 63/017,265, "REMOTE FAST HARDENING OF SELF-PASSIVATING METALS USING LOW TEMPERATURE NITROCARBURIZATION," filed Apr. 29, 2020 and U.S. Provisional Application No. 63/017,271, "TEMPERATURE PROTOCOLS FOR FAST HARDENING OF SELF-PASSIVATING METALS USING LOW TEMPERATURE NITROCARBURIZATION," filed on Apr. 29, 2020, the entirety of each of which are hereby incorporated by reference.

FIELD

This disclosure relates to coatings in metal working. It relates to coatings used for various purposes, including for facilitating hardening of metals. It also relates to coatings used to apply or block the application of reagents to metal surfaces. The reagents may activate and/or harden the metal surfaces, where the hardening occurs via carburization, nitriding, nitrocarburization, and carbonitriding.

BACKGROUND

Conventional Carburization

Conventional (high temperature) carburization is a widely used industrial process for enhancing the surface hardness of shaped metal articles ("case hardening"). In a typical commercial process, the workpiece or article (herein the terms "workpiece" and "article" are used interchangeably) is contacted with a carbon-containing gas at elevated temperature (e.g., 1,000° C. or more) whereby carbon atoms liberated by decomposition of the gas diffuse into the workpiece's surface. Hardening occurs through the reaction of these diffused carbon atoms with one or more metals in the workpiece thereby forming distinct chemical compounds, i.e., carbides, followed by precipitation of these carbides as discrete, extremely hard, crystalline particles in the metal matrix forming the workpiece's surface. See, Stickels, "Gas Carburizing", pp 312 to 324, Volume 4, ASM Handbook, © 1991, ASM International.

Stainless steel is corrosion-resistant because the chromium oxide surface coating that immediately forms when the steel is exposed to air is impervious to the transmission of water vapor, oxygen and other chemicals. Nickel-based, cobalt-based, manganese-based and other alloys containing significant amounts of chromium, typically 10 wt. % or more, also form these impervious chromium oxide coatings. Other alloys exhibit a similar phenomenon in that they also immediately form oxide coatings when exposed to air which are also impervious to the transmission of water vapor, oxygen and other chemicals.

These alloys are said to be self-passivating, not only because they form oxide surface coatings immediately upon exposure to air but also because these oxide coatings are impervious to the transmission of water vapor, oxygen and other chemicals. These coatings are fundamentally different from the iron oxide coatings that form when iron and other low alloy steels are exposed to air, e.g., rust. This is because these iron oxide coatings are not impervious to the transmission of water vapor, oxygen and other chemicals, as can be appreciated by the fact that these alloys can be completely consumed by rust if not suitably protected.

When stainless steel is traditionally carburized, the chromium content of the steel is locally depleted through the formation of the carbide precipitates responsible for surface hardening. As a result, there is insufficient chromium in near-surface areas immediately surrounding the chromium carbide precipitates to form the protective chromium oxide on the surface. Since the corrosion resistance of the steel is compromised, stainless steel is rarely case-hardened by conventional (high temperature) carburization,

Low Temperature Carburization

In the mid 1980's, a technique for case hardening stainless steel was developed in which the workpiece is contacted with a carbon-containing gas at low temperature, typically below ~500° C. At these temperatures, and provided that carburization does not last too long, carbon atoms liberated by decomposition of the gas diffuse into the workpiece surfaces, typically to a depth of 20-50 μm, without formation of carbide precipitates. Nonetheless, an extraordinarily hard case (surface layer) is obtained. Because carbide precipitates are not produced, the corrosion resistance of the steel is unimpaired, even improved. This technique, which is referred to a "low temperature carburization," is described in a number of publications including U.S. Pat. Nos. 5,556,483, 5,593,510, 5,792,282, 6,165,597, EPO 0787817, Japan 9-14019 (Kokai 9-268364) and Japan 9-71853 (Kokai 9-71853).

Nitriding and Carbonitriding

In addition to carburization, nitriding and carbonitriding can be used to surface harden various metals. Nitriding works in essentially the same way as carburization except that, rather than using a carbon-containing gas which decomposes to yield carbon atoms for surface hardening, nitriding uses a nitrogen containing gas which decomposes to yield nitrogen atoms for surface hardening.

In the same way as carburization, however, if nitriding is accomplished at higher temperatures and without rapid quenching, hardening occurs through the formation and precipitation of discrete compounds of the diffusing atoms, i.e., nitrides. On the other hand, if nitriding is accomplished at lower temperatures without plasma, hardening occurs without formation of these precipitates through the stress placed on the crystal lattice of the metal by the nitrogen atoms which have diffused into this lattice. As in the case of carburization, stainless steels are not normally nitrided by conventional (high temperature) or plasma nitriding, because the inherent corrosion resistance of the steel is lost when the chromium in the steel reacts with the diffusion nitrogen atoms to cause nitrides to form.

In carbonitriding, the workpiece is exposed to both nitrogen and carbon-containing gases, whereby both nitrogen atoms and carbon atoms diffuse into the workpiece for surface hardening. In the same way as carburization and nitriding, carbonitriding can be accomplished at higher temperatures, in which case hardening occurs through the formation of nitride and carbide precipitates, or at lower temperatures in which case hardening occurs through the sharply localized stress fields that are created in the crystal lattice of the metal by the interstitially dissolved nitrogen and carbon atoms that have diffused into this lattice. For convenience, all three of these processes, i.e., carburization, nitriding and carbonitriding, are collectively referred to in this disclosure as "low temperature surface hardening" or "low temperature surface hardening processes."

Activation

Because the temperatures involved in low temperature surface hardening are so low, carbon and/or nitrogen atoms will not penetrate the chromium oxide protective coating of stainless steel. Therefore, low temperature surface hardening of these metals is normally preceded by an activation ("depassivation") step in which the workpiece is contacted with a halogen containing gas such as HF, HCl, $NF_3$, $F_2$ or $Cl_2$ at elevated temperature, e.g., 200 to 400° C., to make the steel's protective oxide coating transparent to the passage of carbon and/or nitrogen atoms.

WO 2006/136166 (U.S. Pat. No. 8,784,576) to Somers et al., the disclosure of which is incorporated herein by reference, describes a modified process for low temperature carburization of stainless steel in which acetylene is used as the active ingredient in the carburizing gas, i.e., as the source compound for supplying the carbon atoms for the carburization process. As indicated there, a separate activation step with a halogen containing gas is unnecessary, because the acetylene source compound is reactive enough to depassivate the steel as well. Thus, the carburization technology of this disclosure can be regarded as self-activating.

WO 2011/009463 (U.S. Pat. No. 8,845,823) to Christiansen et al., the disclosure of which is also incorporated herein by reference, describes a similar modified process for carbonitriding stainless steel in which a reagent in the form an oxygen-containing "N/C compound" such as urea, formamide and the like is used as the source for nitrogen and carbon atoms needed for the carbonitriding process. The technology of this disclosure can also be considered to be self-activating, because a separate activation step with a halogen containing gas is also said to be unnecessary.

Surface Preparation and the Beilby Layer

Low temperature surface hardening is often done on workpieces with complex shape. To develop these shapes, some type of metal shaping operation is usually required such as a cutting step (e.g., sawing scraping, machining) and/or a wrought processing step (e.g., forging, drawing, bending, etc.). As a result of these steps, structural defects in the crystal structure as well as contaminants such as lubricants, moisture, oxygen, etc., are often introduced into the near-surface region of the metal. As a result, in most workpieces of complex shape, there is normally created a highly defective surface layer having a plastic deformation-induced extra-fine grain structure and significant levels of contamination. This layer, which can be up to 2.5 μm thick and which is known as the Beilby layer, forms immediately below the protective, coherent chromium oxide layer or other passivating layer of stainless steels and other self-passivating metals.

As indicated above, the traditional method for activating stainless steels for low temperature surface hardening is by contact with a halogen containing gas. These activating techniques are essentially unaffected by this Beilby layer.

However, the same cannot be said for the self-activating technologies described in the above-noted disclosures by Somers et al. and Christiansen et al. in which the workpieces are activated by contact with acetylene or an "N/C compound." Rather, experience has shown that, if a stainless steel workpiece of complex shape is not surface treated by electropolishing, mechanical polishing, chemical etching or the like to remove its Beilby layer before surface hardening begins, the self-activating surface hardening technologies of these disclosures either do not work at all or, if they do work somewhat, produce results which at best are spotty and inconsistent from surface region to surface region.

See, Ge et al., The Effect of Surface Finish on Low-Temperature Acetylene-Based Carburization of 316L Austenitic Stainless Steel, METALLURGICAL AND MATERIALS TRANSACTIONS B, Vol. 458, December 2014, pp 2338-2345, ©2014 The Minerals, Metal & Materials Society and ASM International. As stated there, "[stainless] steel samples with inappropriate surface finishes, due for example to machining, cannot be successfully carburized by acetylene-based processes." See, in particular, FIG. 10 (a) and the associated discussion on pages 2339 and 2343, which make clear that a "machining-induced distributed layer" (i.e., a Beilby layer) which has been intentionally introduced by etching and then scratching with a sharp blade cannot be activated and carburized with acetylene even though surrounding portions of the workpiece which have been etched but not scratched will readily activate and carburize. As a practical matter, therefore, these self-activating surface hardening technologies cannot be used on stainless steel workpieces of complex shape unless these workpieces are pretreated to remove their Beilby layers first.

To address this problem, U.S. Pat. No. 10,214,805 discloses a modified process for the low temperature nitriding or carbonitriding of workpieces made from self-passivating metals in which the workpiece is contacted with the vapors produced by heating a reagent that is an oxygen-free nitrogen halide salt. As described there, in addition to supplying the nitrogen and optionally carbon atoms needed for nitriding and carbonitriding, these vapors also are capable of activating the workpiece surfaces for these low temperature surface hardening processes even though these surfaces may carry a Beilby layer due to a previous metal-shaping operation. As a result, this self-activating surface hardening technology can be directly used on these workpieces, even though they define complex shapes due to previous metal-shaping operations and even though they have not been pretreated to remove their Beilby layers first.

Methods for Applying Reagent

As discussed above, most treatment methods apply reagent to the workpiece surfaces targeted for treatment via contact and/or placing the reagent in close proximity to the workpiece. Such techniques can have the disadvantage of not being able to target particular surfaces of the workpiece, or particular portions of workpiece surfaces, for treatment. Many of the methods treat all exposed workpiece surfaces the same way, even when the surfaces do not have an equal need for treatment. Thus, there is a need for a way to selectively apply reagent to particular surfaces, or particular portions of workpiece surfaces, targeted for selective treatment. There is also a more general need for flexibility in coating workpieces and articles for various chemical processes. New coatings and methods need to be developed to increase the type and efficacy of reagents and other chemical agents used in materials processing.

SUMMARY

Aspects of the present disclosure include a method for treating a workpiece made of self-passivating metal and having a Beilby layer including applying a coating to at least a portion of a surface of the workpiece, the coating including a reagent. The method also includes treating the coating to thermally alter the reagent. The thermal altering of the reagent activates the surface for hardening.

Treating the coating may include heating to a temperature that decomposes the reagent. The method may include hardening the surface. The hardening may include at least one of nitriding, carburizing, nitrocarburizing, and carbonitriding. The thermal altering the reagent may supply at least one of nitrogen and carbon for the hardening. The surface may be one of a plurality of surfaces on the workpiece. Applying the coating may include applying the coating selectively to the surface but not to one or more of the other surfaces of the plurality of surfaces on the workpiece. Applying the coating may include applying the coating selectively to a portion of the surface. The coating may be at least one of a powder coating, electrostatic powder coating, fluidized bed, and centrifugal force-controlled spin coating. The coating may include a polymer with a staged, non-reacted monomer. The polymer may be melamine.

The reagent may be associated with HCl when in the powder. The coating may be water based. The coating may include a vehicle including at least one of water, water-based polyethylene oxide coating or polyvinyl acetate, and a water-based polypropylene oxide coating. The method may include drying the coating. Drying the coating may remove the vehicle from the coating. The water may be evaporated in a furnace to leave the reagent. Evaporating may include at least one of applying a vacuum and evaporating at a temperature below an activation or hardening temperature of the reagent. The water may not chemically interfere with an activation or hardening process. HCl may be complexed with the reagent.

The coating may be oil based. The oil may include at least one of mineral oil, finely distilled oil, food-grade oil, a paraffinic oil, a hydrocarbon based machining oil, and an emulsion based machining oil. The oil may be evaporated in a furnace to leave the reagent. Evaporating may include at least one of applying a vacuum and evaporating at a temperature below an activation or hardening temperature of the reagent. The oil may not chemically interfere with an activation or hardening process. HCl may be complexed with the reagent.

The coating may be liquid or molten. The coating may be deposition based. The coating may be solvent based. The reagent may include an oxygen-free nitrogen halide salt. The reagent may include a non-polymeric N/C/H compound.

The surface may include a passivation layer. The reagent may include at least one of Dimethylbiguanide HCl, Guanidine HCl, Biguanide HCl, Bis(diaminomethylidene)guanidine HCl, Carbamimidoylimidodicarbonimidic diamide HCl, or Melamine HCl. The coating may include a petroleum distillate. The method may include evaporating the petroleum distillate to leave a dry mixture of the reagent.

Aspects of the present disclosure also include a workpiece having a Beilby layer treated according to the method. Applying a coating to the workpiece may include providing the reagent as part of a paraffinic oil. The paraffinic oil may be hydrocarbon or emulsion based. The paraffinic oil may be evaporated in a furnace to leave the reagent and modify the portion. The evaporating may include applying a vacuum. The evaporating may be performed at a temperature below an activation or hardening temperature of the reagent. The paraffinic oil may not chemically interfere with an activation or hardening process.

Aspects further include a coating composition for treating a workpiece made of self-passivating metal and having a Beilby layer. The composition includes a reagent vehicle and a reagent comprising a guanidine [$HNC(NH_2)_2$] moiety and associated with HCl to activate the workpiece for low temperature interstitial surface hardening, The reagent may include at least one of an oxygen-free nitrogen halide salt and a non-polymeric N/C/H compound. The reagent vehicle may include at least one of a powder, a water-based liquid, an oil, and a solvent. The method may also include one or more of carburizing, nitriding, or nitrocarburizing the workpiece to harden the workpiece.

Aspects of the present disclosure also include a method for treating a workpiece made of self-passivating metal and having a Beilby layer including applying a coating to at least a portion of a surface of the workpiece. The coating substantially prevents carburizing, nitriding, or nitrocarburizing of the portion. The method may also include one or more of carburizing, nitriding, or nitrocarburizing the workpiece to harden the workpiece. The coating may be copper or another metal. The method may include thermally treating a reagent to activate uncoated portions of the workpiece for the one or more of carburizing, nitriding, or nitrocarburizing the workpiece to harden the workpiece. The reagent may include at least one of Dimethylbiguanide HCl, Guanidine HCl, Biguanide HCl, Bis(diaminomethylidene)guanidine HCl, Carbamimidoylimidodicarbonimidic diamide HCl, or Melamine HCl.

DETAILED DESCRIPTION

Overview

According to an aspect of the present disclosure, coatings (e.g., coatings including activating reagent) are applied to workpieces/articles. The coatings may facilitate the hardening processes discussed above and in the references cited herein.

In some cases, the coating's reagent may also or alternatively facilitate heat treatments to portions of the surface of the workpiece. Coatings may include various workpieces in addition to the reagent, e.g., a "vehicle" (i.e., e.g., any chemical or substance that supports and/or conveys the reagent, such as a solvent, powder, paste, spray, dip, and colloid) to facilitate coating application, wetting, and/or adherence to the workpiece surface.

The coatings may chemically alter the surface of a workpiece. For example, they may activate the surface for hardening through any of the methods discussed herein (e.g., carburization, nitriding, nitrocarburization, and carbonitriding) or incorporated by reference. They may perform other chemical reactions on the surface of the workpiece that impart a chemical on that surface, remove a chemical from the surface, and/or change the surface chemistry in some other way.

Unless otherwise indicated, the coatings disclosed herein, including in the working examples, are mixed into a uniform dispersion using appropriate dispersive mixing equipment such as planetary mixers (with or without vacuum), 3 roll mills, grinders, ball mills, or hand grinding with mortar and pestle. One of ordinary skill would understand how to perform these procedures such that the resulting coatings are uniform in appearance with no lumps or inhomogeneity, and so that the active ingredients (e.g., reagent, vehicle, etc.) are substantially uniformly dispersed.

Use of this Disclosure

Hardening Methods

The present disclosure may facilitate hardening processes described explicitly herein, below or in the Background section, and/or implied or incorporated by reference. It may, for example, facilitate any of the hardening processes described in U.S. patent application Ser. No. 17/112,076, "CHEMICAL ACTIVATION OF SELF-PASSIVATING METALS," to Cyprian Adair William Illing et al., filed on Dec. 4, 2020, herein incorporated by reference in its entirety. Such hardening methods include any that harden steel or alloys using nitrogen and/or carbon diffusion, particularly interstitial diffusion. These include conventional carburization, low temperature carburization, nitriding, carbonitriding, and nitrocarburization, as discussed above. They include hardening processes involving the use of reagents or other chemicals, as described herein. The reagents may activate the metal for hardening, for example by rendering a passivation layer such that it allows diffusion of nitrogen and/or carbon. The coatings disclosed herein may also be used in hardening processes that do not involve the diffusion of carbon or nitrogen (e.g., mechanical working techniques). The coatings described herein may be compatible with one or more of these hardening processes, when the processes are performed simultaneously and/or in concert. They may be used to prevent hardening, and or other physical and chemical processes, on certain portions of a workpiece.

Products to which Coatings of the Present Disclosure can be Applied

Coatings described herein can be applied to any of the materials disclosed that may be used to form workpieces or metal articles of manufacture. These typically include steels, especially stainless steels. Exemplary steels include 304SS, 384SS, 316SS, 317SS, alloy 254, alloy 6HN, etc. The coatings may be applied to nickel alloys, nickel steel alloys, Hastelloy, nickel-based alloys. Exemplary nickel-based alloys include alloy 904L, alloy 20, alloy 825, alloy 625, alloy C276, alloy C22, etc. The coatings may also be applied to duplex alloys, cobalt-based alloys, manganese-based alloys and other alloys containing significant amounts of chromium, titanium-based alloys. However, they are not limited to such materials, and can apply to any metal. In some variations, they may also be applied to non-metals.

It is to be understood that the coatings herein are intended to be used with worked materials, as described above. In particular, the coatings are intended to facilitate activating workpieces for hardening in the presence of a Beilby layer.

Property Altering Coatings

Coatings disclosed herein may alter the properties, mechanical, thermodynamic, bioactive, physical, chemical, and/or electrical, magnetic of the workpiece surface. For example, the coatings, including for example the reagents disclosed herein, may activate the surface for any of the hardening processes disclosed herein, and as described in the background section. Coatings may simply block portions of the surface from applications of other coatings and/or exposure to liquid or gaseous species. One example is a copper coating that prevents portions from exposure to, for example, vapors, such as those emanating from the pyrolysis of a chemical regent (e.g., any of the chemical regents disclosed, described, referenced, or implied herein). The workpiece surface may have one or more coating types/compositions to apply different properties on different portions of the same workpiece.

Exemplary coatings can be applied to impart corrosion resistance on a surface. Suitable coatings create a non-homogeneous top layer amalgam of iron or nickel-based alloy metal atoms. Some such coatings comprise one or more metallic phases, including at least one or more of austenite, martensite, and ferrite. Some such coatings contain one or more of interstitial carbon atoms, interstitial nitrogen atoms, dispersion of minute metal carbide precipitates, dispersion of minute metal carbide precipitates, dispersion of minute metal nitride precipitates, coarse metal carbide precipitates, and coarse metal nitride precipitates.

After the coating is applied, a treatment may use the coating to alter properties of the underlying workpiece. For example, a heat treatment may cause the coatings may activate the workpiece/workpiece for hardening processes, such as nitriding, carburizing, and nitrocarburizing in the hardening processes discussed above and in the references cited herein. Treating the applied coating by heating may also result in the actual hardening process, e.g., where nitrogen and/or carbon released during treating diffuse into the surface of the workpiece to thereby harden the workpiece surface.

Coating Properties that May be Optimized within the Context of the Present Disclosure Coating materials disclosed herein may be optimized for certain applications. One example is to facilitate dispersion and application of a specific reagent disclosed herein. Chemical or physical aspects of coatings may be altered depending on factors such as the specific reagent used, the material to be coated, and the processing (e.g., hardening or heating) to be facilitated by the coating. Chemical and physical properties of the coatings disclosed herein may be altered for similar reasons. These alterations, whether explicitly described herein or not, should be considered as part of the instant disclosure.

Coating materials may also be designed, formulated, and/or applied to coat specific portions of a workpiece's surface. For example, coatings may include solvent mixes containing appropriate stoichiometric or volumetric amounts of reagent to coat particular areas of the workpiece's surface. Coating properties can be tuned to selectively coat portions of the workpiece's surface (e.g., finished valve-product media contacting passages).

Exemplary Reagents Used in Coatings of the Present Disclosure

In accordance with the present disclosure, the coatings may include a class of non-polymeric N/C/H compounds as a reagent including a guanidine $[HNC(NH_2)_2]$ moiety or functionality with an HCl association (e.g., complexing). These reagents have been shown to improve hardening, corrosion resistance, and/or abrasion resistance.

In particular, results show that at least three reagents belonging to this system, 1,1-Dimethylbiguanide HCl (hereinafter, "DmbgHCl"):

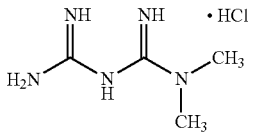

and Guanidine HCl (hereinafter, "GuHCl"):

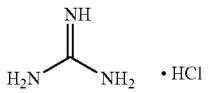

and Biguanide HCl (BgHCl) have successfully induced extremely rapid surface hardening under low temperature conditions. The guanidine [$HNC(NH_2)_2$] moiety or functionality with HCl complexing is the chemical structure common to both DmbgHCl, GuHCl, and BgHCl. Other reagents tested lacking the guanidine moiety were have not demonstrated producing ~20 μm case depth in 2 hours or less under similar conditions.

Other compounds including guanidine with HCl are also suitable, e.g., Melamine HCl (MeHCl), may provide similar results. Other guanidine containing compounds that might achieve similar results in this context include triguanides (the basic structure of triguanides is:

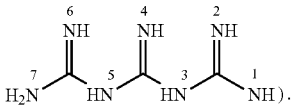

Examples of guanides, biguanides, biguanidines and triguanides that produce similar results include chlorhexidine and chlorohexidine salts, analogs and derivatives, such as chlorhexidine acetate, chlorhexidine gluconate and chlorhexidine hydrochloride, picloxydine, alexidine and polihexanide. Other examples of guanides, biguanides, biguanidines and triguanides that can be used according to the present invention are chlorproguanil hydrochloride, proguanil hydrochloride (currently used as antimalarial agents), metformin hydrochloride, phenformin and buformin hydrochloride (currently used as antidiabetic agents).

Guanidine moiety reagents may or may not be complexed with HCl. Reagent complexing with any hydrogen halide may achieve similar results. Guanidine moiety reagents without HCl complexing may also be mixed with other reagents, such as the other reagents discussed in U.S. patent Ser. No. 17/112,076, having HCl complexing. An important criterion may be whether the reagent or mix of reagents has a liquid phase while decomposing in the temperature ranges of low temperature nitrocarburization (e.g., 450 to 500 C). The extent to which reagents evaporate without decomposing, before reaching that temperature range is an important consideration.

Coatings Products

In accordance with the present disclosure, products comprising coating compositions and articles coated with the coating compositions are contemplated. The coating composition may comprise a reagent vehicle in accordance with the present disclosure. The reagent may comprise, for example, a guanidine [$HNC(NH_2)_2$] moiety and associated with HCl to activate the workpiece for low temperature interstitial surface hardening. It may comprise any other reagent disclosed or referenced herein.

The coating composition can be delivered via a gas, a liquid, paste, semi-liquid, semi-solid, gel, or powder. It may be applied by any suitable means for coating a metallic or solid article/workpiece. Those means include spraying, atomized spray, immersing (dip), spray drying, sputter (or other) depositing, adsorption, chemical vapor deposition (CVD), physical vapor deposition (PVD), printing, evaporative deposition, spin coating, electrostatic deposition, via fluidized bed, centrifugal force, etc. It may include any of the coating vehicles disclosed herein. It may be any type of coating discussed below.

Coatings Application

Coatings may be applied to the materials discussed above and in the references cited herein, and by any method described in the "Coatings Products" section above. For example, coatings may be applied to various metals, including various steels (e.g., stainless steels such as 316SS) and nickel steel alloys. They may be applied before or during a hardening and/or heating process. The coatings may be applied selectively to specific portions of the workpiece surface (e.g., flange, ferrule sharp-edge, needle valve stem tip, ball valve orifice rim, etc.) to be subjected to a specific treatment facilitated by the coating (e.g., hardening). In other words, the coating may be applied to at least a portion of the surface of the workpiece for selective treatment of that portion of the surface of the workpiece.

In certain aspects, the coatings may contain reagent and are applied to at least a portion of the surface of the workpiece so as to harden that portion of the surface or as to form an interstitial case in that portion for corrosion resistance, abrasion resistance, changes in magnetic, electrical, thermodynamic, bioactive, or mechanical properties. In other embodiments, the coating does not contain reagent and instead masks the surface to block treatment, e.g., heat treatment and/or surface hardening on that portion. In aspects, the coatings are applied in constant volume processing, such as the constant volume processing hardening processes described herein. In aspects, they are applied via closed or clamped openings. In aspects, the coatings are applied in a modified atmosphere to, for example, enhance coatings (e.g., pressurized or vacuum environments) and/or prevent contamination. In aspects, the coatings include other chemicals to facilitate or carry reagent, e.g., urea with or without HCl association.

Coatings may be applied at temperatures below the temperature at which the reagent in the coating starts to decompose or change its chemical characteristics. The coatings may alternatively be applied when their reagents are in a molten state. They can be applied by spray, e.g., atomized spray. In aspects, coatings may be applied electrostatically. Coatings can alternatively be applied by fluidized bed. They may additionally or alternatively be applied by centrifugal force, and/or spin coating. The coatings may be applied to flat or non-flat surfaces, and/or to particular aspects or portions of surfaces. They may be applied selectively to certain surfaces or certain portions of a surface.

Once applied, the coatings may be dried. The drying may remove the vehicle or other components from the coating. The vehicle removal process (e.g., heating) may be performed at a temperature below the temperature of decomposition of the reagent. Subsequent to drying and/or a vehicle removal process, the workpiece with the dried coating may be heated for processing. For example, the workpiece may be heated to a temperature sufficient to decompose the reagent in the coating to provide carbon and/or nitrogen for a hardening process as described herein and in any document incorporated herein by reference. Drying may be accomplished via vacuum, desiccant exposure, or by other suitable means.

Exemplary Coating Types

Exemplary coating types are discussed below. It should be understood that these coating types are not mutually exclusive. Some coatings may include aspects of two or more types.

Coatings Including Metal

Some coatings may contain one or more metallic phases, including at least one or more of austenite, martensite, and ferrite. These coatings may also contain the reagents and vehicles disclosed herein. Some coatings may contain metal additives that may be pre-infused with one or more of interstitial carbon atoms, interstitial nitrogen atoms, dispersion of minute metal carbide precipitates, dispersion of minute metal nitride precipitates, coarse metal carbide precipitates, and coarse metal nitride precipitates. The metal additives can assist with the surface hardening process. The metal additives may control or modify the reagent action (surface reactions, pyrolysis mechanisms, catalysis of certain reactions, etc.) with the coated surface. Certain additives may act as seed crystals which drive certain reactions over others in the interstitial case formation in the workpiece. Any type of coating listed below may include metal.

Liquid- or Molten Reagent Type Coatings

Reagent may be applied to the alloy surface by means of a liquified or molten reagent that may include, for example, vehicles, reagents, and additives. These coatings may comprise a typical reagent heated above its melting point. Parts may be immersed, sprayed, or otherwise covered with the non-solid reagent coating. Additives may be added to modify properties including melting temperature, viscosity, wettability, and decomposition pathways.

Powder Type Coatings

Coatings may be substantially powder like, comprising other materials (e.g., vehicles or wetting agents) interspersed with reagent powder. For example, the coating may include metal catalyst (e.g., 316SS or other alloy metal powder) mixed with the reagent. In some cases, including such a metal catalyst with the reagent, the catalyst improves reagent reactivity. The other materials in the coatings may be chemically bonded or complexed with the reagent, or not (e.g., physically mixed with reagent). An exemplary powder type coating comprises polymer and reagent. Exemplary polymers include staged, non-reacted monomers (e.g., melamine). Exemplary coatings include "a staged" monomers (e.g., melamine) prior to "b stage" compounding with additional thermosetting reactives. The reagent powder may be associated with other compounds (e.g., HCl). Powder coatings may also lack reagent.

A powder coating may be sufficiently mechanically durable to adhere to and/or protect workpiece surfaces for extended time periods (e.g., minutes, hours, or days) between coating and treatment (e.g., hardening and/or heating). Appropriate powder size selection and distributions can be obtained by grinding and subsequent sieving operations to product desired flowable mixes and may include flow or anti-caking additives of appropriate particle sizes to avoid clumping and ensure good flow and processability.

Specific, non-limiting examples of powder type coatings in addition to the above that may be used include polyolefin and polypropylene among others.

Water Based Coatings

Water-based coatings may include reagent and a reagent vehicle, and may be of a suspension or emulsion-type water-based solution. Suitable examples of vehicles include surfactants and polypropylene oxide, polyethylene oxide, and polyvinyl acetate among others. Examples of a suitable vehicle include, but are not limited to, non-ionic surfactants including polyethylene oxide, polypropylene oxide, among others. The chemical identities of vehicle and reagent, as well as the stoichiometric ratio of vehicle to reagent (or other components of the coating), may be individually or simultaneously tailored to coat reagent on the workpiece's surface. This may include tailoring for a particular workpiece surface chemistry or morphology. For example, it may be desired to coat difficult to reach and/or obstructed workpiece surfaces (e.g., inner surfaces and/or surfaces that face obstructions). It may be desired to coat complicated workpiece shapes or surfaces, including select portions of those surfaces. Water based coatings in liquid form may be applied via pressurization and/or flushing through the workpiece, especially when coating workpiece inner surfaces. For example, the pressurizing and/or flushing processes may be especially useful for coating media contacting surfaces in finished valve products. Some water-based coatings may be applied by dip coating the workpiece in the coating liquid.

Once applied, a water-based coating may be air or gas dried. Drying may remove the vehicle in the coating, leaving primarily, essentially, or exclusively reagent. Alternatively, the vehicle and reagent remain in the coating, leaving primarily, essentially, or exclusively vehicle and reagent. Drying may be accomplished by conventional blowing means, e.g., blow drying with or without heating the gas stream. The gas(es) may include air, inert gases, or other types of gases. Drying may also be accomplished via vacuum to cause outgassing (e.g., evaporation, or de-solvating) of certain parts of the coating, for example the vehicle. The vacuum treatment may include heating the coating and/or workpiece to temperatures below the decomposition temperature of the coating reagent, e.g., 180 to 200° C. Traps for particular chemical workpieces may assist this process and may be included in the vacuum and/or oven system(s). Fungicide and bacteria controls may also included in the drying process. Outgassing may be monitored to a particular stage (e.g., complete outgassing of coating vehicle) via vacuum gauge or pressure gauges.

Specific, non-limiting examples of water-based coatings that may be used include coatings based on polyethylene oxide, polyvinyl acetate, and polypropylene oxide and mixtures thereof Deposition-Based Coatings Deposition-based coatings may include vehicles, reagents, and additives. Reagent material may be applied to the surface of the workpiece by deposition methods including, but not limited to, PVD and CVD processes. The reagent may be carried by a vehicle chemical species and deposited onto the part surface. Additives to the vehicle or the reagent material may modify a coating and process properties including adhesion, wettability, reagent volatilization and decomposition behavior. Such processes may occur at a variety of temperatures and pressures to achieve the desired coating thickness, location specificity, coating morphology, and coating composition.

Non-Water Solvent Based Coatings

Various solvents, solvent blends, or other modifiers to tailor rheological properties and enhance processability may also be included in the coatings (powder, liquid, paste, gel, etc.) disclosed herein. Solvent-based coatings may include vehicles, reagents, and additives. Suitable vehicles include solvents. Coatings may also include solvent mixes that can be removed via appropriate process conditions conducing to drying/evaporation while depositing a coating of reagents on the surface. Vehicles can include viscosity and surface-active agents to facilitate the coating application and adhesion/wetting to the surface, as well as the suspension of the reagent in the coating vehicle.

Solvent based coatings can be applied and off-gassed/dried in a similar method. Alcohol and alcohol solvent mixes with appropriate solubility, viscosity and distillation points are examples of suitable solvent mixes. Similar mixtures exist in fluxing operations during printed wiring board and other electronic manufacturing processes. Such processes are typically dried under a nitrogen blanket. Such coatings may or may not contain a vehicle that lends itself to a cohesive dry coating which encapsulates or suspends the chemical reactants. This vehicle upon heating may leave the system into the gas phase, leaving the desired reagent chemicals behind. The temperature of vehicle vaporization may be above the solvent drying temperature, but below the temperature at which the reagent interacts with the metal surface causing activation and/or surface hardening. Drying may also be accomplished by heating the coated workpiece.

Solvent mixes containing appropriate stoichiometric or volumetric amounts of reagent may be used to coat some workpieces. They can selectively coat finished valve-product media contacting passages or hardened tooling, for example. This process may have some similarities to flux applications for electronic workpieces.

Examples of solvents include, but are not limited to organic solvents. Non-limiting specific examples of such organic solvents include toluene, acetone, methylamine, chloroform, acetonitrile, isopropanol, ethanol, dioxane, dimethylsulfoxone, hexane, aniline, glycerol.

Oil Based Coatings

Oil, including for example, mineral oil, finely distilled oil, and/or food-grade oil, may be used as a vehicle to coat workpiece surfaces with reagent. The oil may include a dispersion of reagent with a concentration or volume fraction tailored for specific applications (e.g., as discussed above in the context of water-based coatings). The oil may also include HCl associated or complexed with reagent in stoichiometric ratio or volume fraction tailored for particular applications. The oil may also include a dispersing agent to help disperse the reagent and/or HCl. The foregoing reagent and/or HCl mixtures may be used to provide, for example, a room temperature coating.

Oil-based coatings, once applied, may be dried and/or outgassed in a similar manner as water-based coatings described above. For example, a vacuum oven outfitted with a roughing pump and cleanable traps for chemical workpieces may be heated to remove the mineral oil. The heating may be to a temperature that is substantially below the decomposition temperature of the reagent. The heating temperature may be chosen based on the oil properties. For example, if the oil is a mineral oil, the heating temperature may be chosen based on the distillate temperature profile of the mineral oil. The oil may be recycled after removal from the coating. Additional distillation or filtration of the recycled oil can improve its purity. The distillation or filtration may be applied during oil removal or as a separate, standalone process, depending on the level of oil contamination.

In an exemplary configuration, machining oils coating a workpiece such as ferrules in a machine working center include reagents. Finished and machined workpieces leave a machine working center wet with the oil including the reagents. The oil-wet workpieces can then be placed in a furnace. The high temperature of the furnace could evaporate the oils leaving a reagent coating on the ferrules. The base oil can be removed aid of vacuum heating to reduce drying times. If vacuum systems are used, the base oil can be recovered and recycled making it more cost effective. If, on the other hand, the oil is not fully evaporated, an oil composition would preferably be chosen that would not interfere with activation and/or hardening reactions. The reagent coating, whether including residual oil or not, could subsequently be used to facilitate activation and/or hardening of the workpiece, as disclosed above.

Both hydrocarbon or emulsion (water based) machining oils can accommodate additives such as the reagents disclosed herein. In fact, such oils typically already contain additives for various purposes, including extending machine tool life, reduce bacterial and fungal blooms, and extending oil life. Reagent, as disclosed herein, can also be added. Hydrocarbon based machine oils can be preferable for more demanding applications, such as those in which the finished machined article/workpiece is complex.

Specific, non-limiting examples of oil-based coatings that may be used, in addition to the above, include finely distilled paraffinic mineral oils, other paraffinic oils, other mineral oils, synthetic oils, various petroleum products, motor oils, plant-based oils, other food-grade oils, hydrocarbon based oils, emulsion based oils, and machining oils for workpieces, among others. Related to oil-based coatings, coatings may also or alternatively include a petroleum distillate. These include mineral oil, naphtha, heavy fuel oil, and waxes. The distillate may be treated as with other vehicles described herein (e.g., evaporated to leave reagent).

EXAMPLES

Unless otherwise indicated, the weight % in the examples refers to the total weight of the coating composition (i.e., prior to drying, if applicable).

Example 1

A glycerol-based heavy paste coating was prepared comprising 84% Guanidine Hydrochloride and 16% glycerol by weight. This coating had an extended working time at room temperature and drying at 290° C. The heavy paste formulation was: 84 weight % Guanidine Hydrochloride and 16% glycerol. The constituents were mixed utilizing dispersive mixing equipment to achieve uniform dispersion. The resulting paste was smooth and uniform in appearance with no lumps or inhomogeneity. This paste was applied to a 316L back ferrule for a 1/16" size tube fitting placed in an alumina crucible pan in a simultaneous thermal analyzer (STA) furnace. The furnace, crucible pan, and ferrule were purged with a constant flow of 70 ml/min nitrogen gas. The ferrule and paste were baked in the furnace at 450° C. for 8 hours and cooled to room temperature. The ferrule was removed, sectioned, and etched to reveal a uniform nitrocarburized case approximately 20 μm deep about the periphery of the ferrule, as observed via optical microscopy. This example was repeated three times. The case depth average for all four examples was 20.36 μm±2.24 μm.

Example 2

Same as Example 1 except the ferrule was alloy 6HN. This example was repeated once. The case depth average for both examples was 11.0 μm±1.0 μm.

Example 3

A low viscosity coating for casting or spraying at room temperatures with short dry times (less than 1 hour) was prepared. The coating was 16 weight % Guanidine Hydrochloride, 83.9 weight % isopropyl alcohol, and 0.01 weight % glycerol. The components were mixed in the following order: Guanidine Hydrochloride, isopropyl alcohol, and glycerol using dispersive mixing equipment. The resulting low viscosity coating was uniform in appearance with no lumps or inhomogeneity.

Example 4

Another example of a heavy paste coating was prepared with an unlimited working time for application to article surfaces. The coating was 85 weight % Guanidine Hydrochloride and 15 weight % mineral oil mixed utilizing dispersive mixing equipment until reaching a uniform dispersion. The paste was smooth and uniform in appearance with no lumps or inhomogeneity.

Example 5

A water based coating was prepared having a wet film thickness greater than 25 mils and a dry film thickness of 0.46 mm. The working time is less than 2 hours and complete dry time is 24 hours at room temperature. The coating was prepared by mixing 17 weight % Guanidine Hydrochloride with 66 weight % polyvinyl acetate-based white glue (Elmer's Products E308) in dispersive mixing equipment, then adding 17 weight % deionized water. The resulting paste was smooth and uniform in appearance with no lumps or inhomogeneity. The dry coating was uniform, cohesive, and durable enough for handling articles and conveyance post drying.

Example 6

Another heavy paste was prepared with an unlimited working time for application to article surfaces. The paste was 85 weight % Guanidine Hydrochloride and 15 weight % paraffinic oil prepared by mixing until a uniform dispersion in dispersive mixing equipment. The resulting paste was smooth and uniform in appearance with no lumps or inhomogeneity.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value and values within 10% of the specified value, unless expressly stated otherwise. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A method for treating a workpiece made of self-passivating metal and having a Beilby layer including:

applying a coating to at least a portion of a surface of the workpiece, the coating including a reagent, wherein the surface is one of a plurality of surfaces on the workpiece and applying the coating includes applying the coating selectively to the surface but not to one or more of the other surfaces of the plurality of surfaces on the workpiece; and treating the coating to thermally alter the reagent, wherein the thermal altering of the reagent activates the surface for hardening.

2. The method of claim 1, wherein the treating the coating includes heating to a temperature that decomposes the reagent.

3. The method of claim 1, further including hardening the surface.

4. The method of claim 3, wherein the hardening includes at least one of nitriding, carburizing, nitrocarburizing, and carbonitriding.

5. The method of claim 3, wherein the thermal altering the reagent supplies at least one of nitrogen and carbon for the hardening.

6. The method of claim 1, wherein applying the coating includes applying the coating selectively to a portion of the surface.

7. The method of claim 1, wherein the coating is at least one of a powder coating, electrostatic powder coating, fluidized bed coating, and centrifugal force-controlled spin coating.

8. The method of claim 7, wherein the coating includes a polymer with a staged, non-reacted monomer.

9. The method claim 8, wherein the polymer is melamine.

10. The method of claim 7, wherein the reagent is associated with HCl when in the powder.

11. The method of claim 1, wherein the coating is water based.

12. The method of claim 11, wherein the coating includes a vehicle including at least one of water, water-based polyethylene oxide coating, water-based polyvinyl acetate coating, and a water-based polypropylene oxide coating.

13. The method of claim 11, further including drying the coating.

14. The method of claim 13, wherein drying the coating removes the vehicle from the coating.

15. The method of claim 1, wherein the coating is oil based.

16. The method of claim 15, wherein the oil includes at least one of mineral oil, finely distilled oil, food-grade oil, a paraffinic oil, a hydrocarbon based machining oil, and an emulsion based machining oil.

17. The method of claim 16, wherein the oil is evaporated in a furnace to leave the reagent.

18. The method of claim 17, wherein the evaporating includes at least one of:

applying a vacuum; and evaporating at a temperature below an activation or hardening temperature of the reagent.

19. The method of claim 15, wherein the oil does not chemically interfere with an activation or hardening process.

20. The method of claim 15, wherein HCl is complexed with the reagent.

21. The method of claim 1, wherein the coating is liquid or molten.

22. The method of claim 1, wherein the coating is deposition based.

23. The method of claim 1, wherein the coating is solvent based.

24. The method of claim 1, wherein the reagent includes an oxygen-free nitrogen halide salt.

25. The method of claim 1, wherein the reagent includes a non-polymeric N/C/H compound.

26. The method of claim 1, wherein the surface includes a passivation layer.

27. The method of claim 1, wherein the reagent includes at least one of Dimethylbiguanide HCl, Guanidine HCl, Biguanide HCl, Bis(diaminomethylidene)guanidine HCl, Carbamimidoylimidodicarbonimidic diamide HCl, or Melamine HCl.

28. The method of claim 1, wherein the coating includes a petroleum distillate.

29. The method of claim 28, further including evaporating the petroleum distillate to leave a dry mixture of the reagent.

30. A method for treating a workpiece made of self-passivating metal and having a Beilby layer including:

applying a coating to at least a portion of a surface of the workpiece, wherein the coating substantially prevents carburizing, nitriding, or nitrocarburizing of the portion; and one or more of carburizing, nitriding, or nitrocarburizing the workpiece to harden the workpiece.

31. The method of claim 30, wherein the coating is copper or another metal.

32. The method of claim 30, further include thermally treating a reagent to activate uncoated portions of the workpiece for the one or more of carburizing, nitriding, or nitrocarburizing the workpiece to harden the workpiece.

33. The method of claim 30, wherein the reagent includes at least one of Dimethylbiguanide HCl, Guanidine HCl, Biguanide HCl, Bis(diaminomethylidene)guanidine HCl, Carbamimidoylimidodicarbonimidic diamide HCl, or Melamine HCl.

* * * * *